US011002435B2

(12) United States Patent
Oliver et al.

(10) Patent No.: US 11,002,435 B2
(45) Date of Patent: May 11, 2021

(54) ANCHOR AND LIGHT POST ASSEMBLY

(71) Applicant: Oliver Technologies, Inc., Hohenwald, TN (US)

(72) Inventors: Scott Oliver, Linden, TN (US); Daniel Oliver, Linden, TN (US); John A. Oliver, Linden, TN (US)

(73) Assignee: Oliver Technologies, Inc., Hohenwald, TN (US)

( * ) Notice: Subject to any disclaimer, the term of this patent is extended or adjusted under 35 U.S.C. 154(b) by 0 days.

(21) Appl. No.: 16/858,613

(22) Filed: Apr. 25, 2020

(65) Prior Publication Data

US 2020/0340649 A1 Oct. 29, 2020

Related U.S. Application Data

(60) Provisional application No. 62/839,605, filed on Apr. 26, 2019.

(51) Int. Cl.
*F21V 21/06* (2006.01)
*E04H 12/22* (2006.01)

(52) U.S. Cl.
CPC ..... *F21V 21/06* (2013.01); *E04H 12/2253* (2013.01)

(58) Field of Classification Search
CPC ..... F21W 2131/109; F21V 21/0824; F21V 21/06
See application file for complete search history.

(56) References Cited

U.S. PATENT DOCUMENTS

| | | | | |
|---|---|---|---|---|
| 3,828,491 | A | 8/1974 | Koon | |
| 5,697,191 | A | 12/1997 | MacKarvich | |
| 5,850,718 | A | 12/1998 | MacKarvich | |
| 6,094,873 | A | 8/2000 | Hoffman | |
| 6,256,940 | B1 | 7/2001 | MacKarvich | |
| 6,272,798 | B1 | 8/2001 | Cockman | |
| 6,298,611 | B1 | 10/2001 | Oliver | |
| 7,191,569 | B2 | 3/2007 | Brown | |
| 8,833,020 | B2 | 9/2014 | Oliver | |
| 8,844,209 | B1 | 9/2014 | Oliver | |
| 9,206,580 | B2 | 12/2015 | Oliver | |
| 2004/0221543 | A1* | 11/2004 | Eleas | E04H 12/187 52/153 |
| 2009/0038240 | A1 | 2/2009 | Leonard | |

(Continued)

OTHER PUBLICATIONS

Cover page of set of documents for OTI foundation & anchor systems, each document is listed in this IDS separately, Oliver Technologies, Inc. 467 Swan Ave., Hohenwald, TN 38462; Dec. 4, 2002.

(Continued)

*Primary Examiner* — Robert J May
(74) *Attorney, Agent, or Firm* — Baker Donelson; Carl M. Davis, II

(57) ABSTRACT

An assembly for anchoring a light post assembly with a ground anchor that secures to a ground box comprising a plate with a plurality of walls extending in a first direction to penetrate the ground and a plurality of fasteners extending in a second direction from the plate and receiving thereon a light post base having a plurality of openings for aligned receiving of the fasteners and receiving nuts thereon to secure the light post base to the ground box.

12 Claims, 6 Drawing Sheets

(56) References Cited

U.S. PATENT DOCUMENTS

2015/0368924 A1* 12/2015 Izradel ..... E04H 12/2261
362/183

OTHER PUBLICATIONS

Oliver Technologies, Inc.; Manufactured Housing Foundation Systems, A Division of Oliver Technologies, Inc.; Swivel Frame Tie, 467 Swan Ave., Hohenwald, TN 38462; Dec. 4, 2002.
Oliver Technologies, Inc.; Installation Instructions, Model #OTLT, Longitudinal Beam Connector, 467 Swan Ave., Hohenwald, TN 38462; Aug. 13, 2003.
Oliver Technologies, Inc.; Installation Instructions Galvanized Strapping, p. 15; 467 Swan Ave., Hohenwald, TN 38462; Nov. 2002.
Oliver Technologies, Inc.; Wind Zone Map, p. 16: 467 Swan Ave., Hohenwald, TN 38462; Nov. 2002.
Oliver Technologies, Inc.; Specifications, Oliver Technologies, Inc.—Adjustable Outrigger, p. 25; 467 Swan Ave., Hohenwald, TN 38462; Nov. 2002.
Oliver Technologies, Inc.; Specifications, Oliver Technologies, Inc.—Anchors and Components; pp. 26-28; 467 Swan Ave., Hohenwald, TN 38462; Nov. 2002.
Oliver Technologies, Inc.; Installation Instructions Galvanized Strapping, p. 9, 467 Swan Ave., Hohenwald, TN 38462; May 2004.
Oliver Technologies, Inc.; Ground Anchor Installation Instructions, p. 9, 467 Swan Ave., Hohenwald, TN 38462; Nov. 2002.
Oliver Technologies, Inc.; Installation Instructions OTI Auger Anchor, p. 10, 467 Swan Ave., Hohenwald, TN 38462; Nov. 2002.
Oliver Technologies, Inc.; "Quick Anchor Installation Instructions Model #OTCAP1, OTI Anchor Model#'s OT3044BP and OT3646BP", p. 11, 467 Swan Ave., Hohenwald, TN 38462; Nov. 2002.
Oliver Technologies, Inc.; "Ground Anchor Installation Instructions", p. 12, 467 Swan Ave., Hohenwald, TN 38462; Nov. 2002.
Oliver Technologies, Inc.; "Longitudinal Frame Connections OTQC", p. 13, 467 Swan Ave., Hohenwald, TN 38462; Nov. 2002.
Oliver Technologies, Inc.; "I-Beam Frame Connections Swivel Connector (Part# 2001)", p. 14; 476 Swan Ave., Hohenwald, TN 38462; Nov. 2002.

* cited by examiner

ANCHOR AND LIGHT POST ASSEMBLY

TECHNICAL FIELD

The present invention relates to foundation apparatus for securing ornamental light posts to the ground. More particularly, the present invention relates to ground anchor foundation and ornamental light pole assemblies.

BACKGROUND

The lighting trade provides a range of lighting fixtures for ornamental and guidance illumination of yards, driveways, walkways, trees and shrubbery, and residential and other buildings. These lighting fixtures include low-placed spot lights, flood lights, and walkway lights, as well as elongated posts for elevated lighting fixtures. The low-placed lighting fixtures topically have a ground spike for securing the fixture in place. The elongated posts typically mount to threaded bolts that extend from a poured concrete foundation. Installation of poured concrete foundations for lighting posts involves the digging of a receiving hole in the ground, a foundation form, mixing and pouring of the concrete, and seating of threaded fasteners or brackets for fasteners in the wet concrete. After curing, the installer then seats and secures a light post base on the foundation, installs the light post to the base, and makes necessary electrical connections for the light fixture attached to the light post. While the poured concrete foundation adequately supports the installed light post, the drawback is the labor and extended installation time required.

Accordingly, there is a need in the art for an improved foundation and support for elongated light posts. It is to such that the present invention is directed.

BRIEF SUMMARY OF THE INVENTION

The present invention meets the need in the art by providing an anchor and light post assembly, comprising an anchor for engaging a ground surface and a plate configured for attaching to the anchor and having a plurality of fastener members, and a light post base having a plurality of openings for aligned receiving of the fastener members for securing the light post base to the ground box.

In another aspect, the present invention provides a method of securing an anchor and light post assembly for supporting an ornamental light fixture, comprising the steps of:

(a) driving an anchor into a ground surface;

(b) securing a plate to the anchor while compressing the ground between the plate and a lower end of the anchor, the plate having a plurality of fastener members upwardly therefrom; and (c) securing with the fastener members a light post base onto the plate, whereby the light post base is secured to the ground for supporting a light fixture attached to a post extending from the light post base and resisting loading on the light fixture.

Objects, advantages, and features of the present invention will become readily apparent upon a reading of the following detailed description in conjunction with the drawings and the appended claims.

DETAILED DESCRIPTION

Figure 1:
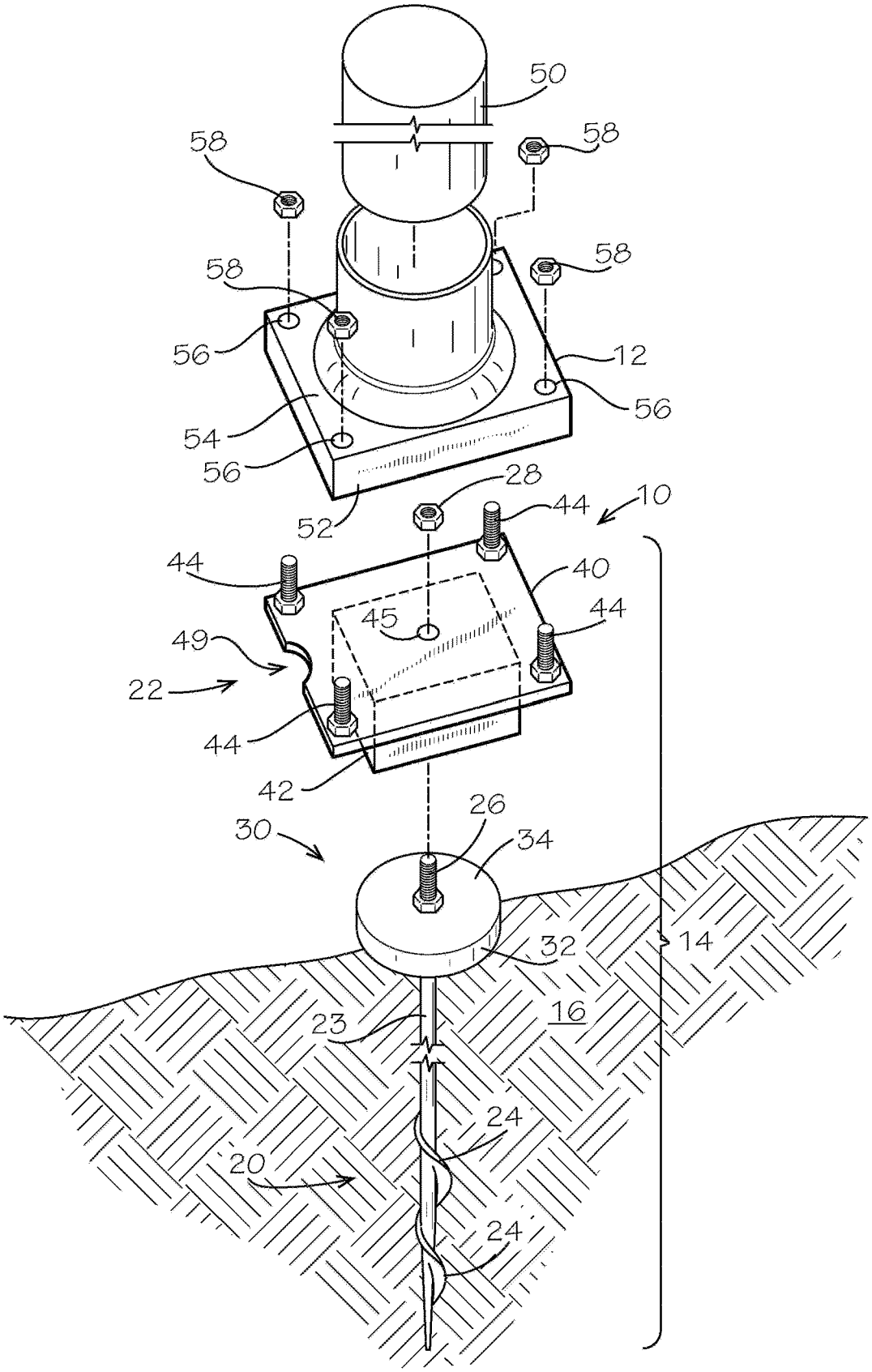
FIG. 1 illustrates in exploded view an anchor and light post assembly according to the present invention.

With reference to the drawings in which like parts have like identifiers, FIG. 1 illustrates in exploded view an assembly 10 for securing a light post base 12 to a foundation 14 engaged to a ground surface 16, in accordance with the present invention. The foundation 14 comprises an elongated anchor 20 and a ground box 22 that attaches to the anchor 20. The anchor 20 is an elongated steel rod 23 having one or more helical flights 24 proximate a first end portion and a threaded opposing distal end 26 that receives a nut 28 as a securing member. Additional helical flights assist with drilling the anchor into the ground 16 and increase the resistance to loading on the anchor and light post assembly 10. The rod 23 may have a longer selected length to further increase load resistance. The helical flights 24 are driven below a frost line for securing the anchor in the ground and resisting ground heave that may occur by the repeated freezing and thawing of ground in winter weather conditions.

In the illustrated embodiment, the threaded distal end comprises a bolt welded coaxially to the rod 23. In the illustrated embodiment, the anchor 20 optionally receives a ground cap 30 on the threaded end 26. The ground cap 30 includes a skirt 32 extending from a cap plate 34. The cap plate 34 defines a central opening through which the threaded end 26 of the anchor post 20 extends. A nut 35 threads on the threaded end 26 to secure the ground cap 30 to the anchor 20. The skirt wall 32 of the ground cap 30 provides resistance against the ground 16 to lateral forces on the assembly 10.

The ground box 22 comprises a plate 40 with a ground-engaging frame 42 extending in a first direction from a bottom surface of the plate and a plurality of threaded fasteners 44 projecting in a second direction from a top surface of the plate. FIG. 1 illustrates the fasteners 44 as bolts welded to an upper surface of the plate 40. The plate 40 defines an opening 45 through which the threaded end 26 of the anchor rod 23 extends for engaging the anchor 20 to the ground box 22. A notch 49 or opening in the plate 40 provides a passageway for electrical wires to pass from a conduit or junction box in the ground and upwardly through the light post base 12 and into the post 50 for electrical communication of a light fixture with a source of electrical current.

Figure 2:
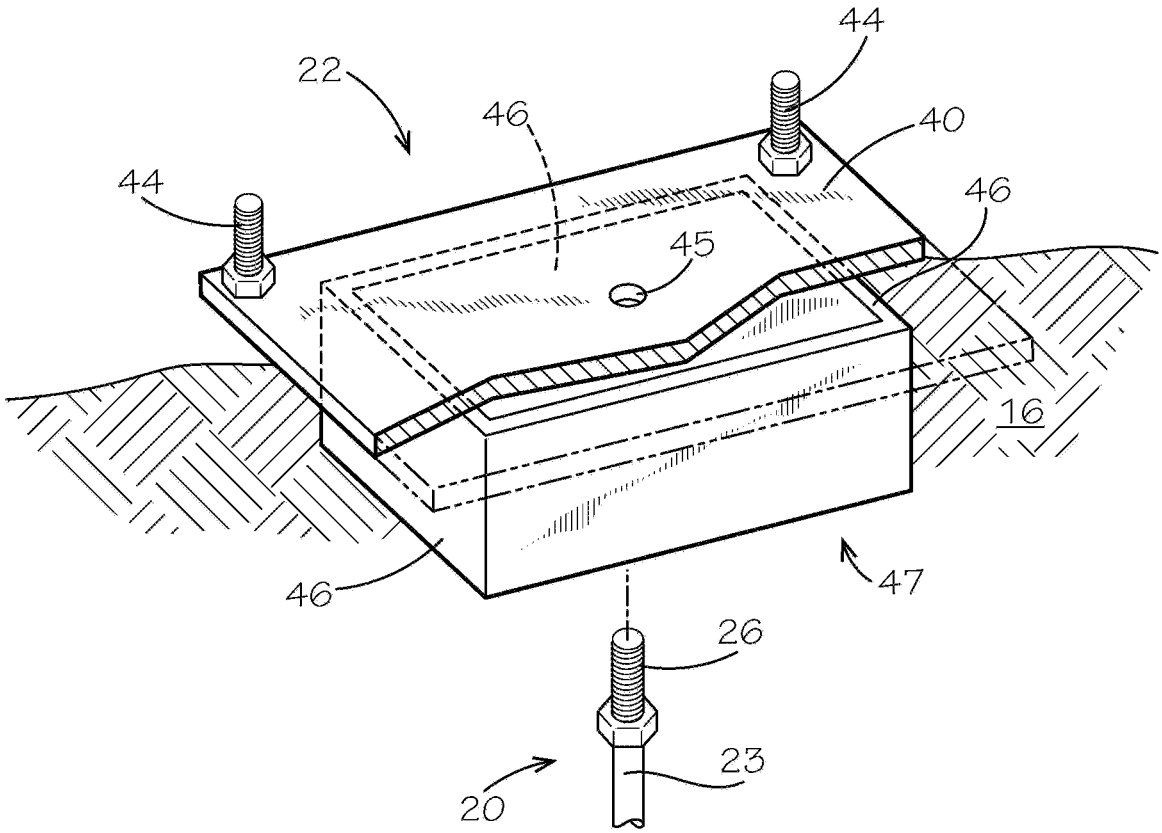
FIG. 2 illustrates in detailed cut-away view a ground box for use with the anchor and light post assembly.

With reference to FIG. 2 that shows the ground box 22 in detailed cut-away view, the ground-engaging frame 42 comprises a plurality of elongate members 46 welded to the plate 40. The elongate members 46 in the illustrated embodiment abut end-to-end to define a fenced box generally 47, which elongate members engage portions of the ground. Each member 46 resists displacement forces by bearing against the ground, which forces are applied to the light post of the assembly 10, such as by wind or other lateral loading. The elongate members 46 may be of a selected larger width for extending deeper into the ground 16 for increased load resistance. The threaded fasteners 44 are bolts welded to the plate 40 in spaced-arrangement.

With continuing reference to FIG. 1, the light post base 12 provides an open-bottom end platform for connecting to the ground box 22. The light post base 12 includes a perimeter skirt or wall 52 extending in a first direction from a base plate 54. An annular collar 55 extends in an opposing direction from the base plate 54 and receives an elongated post 50. Fasteners (not illustrated) such as screws or bolts that engaged threaded connectors on the post 50 secure the post to the collar 55. A lighting fixture (not illustrated) mounts at an upper end of the elongated post 50. The wall 52 provides a structure for engaging the ground laterally around the ground box 22 during installation. The base plate 54 includes a plurality of openings 56 spaced for alignment and receiving of the threaded fasteners 44 of the ground box 22 during installation. Nuts 58 thread on the fasteners 44 to secure the light post base 12 to the ground box 22.

Figure 3:
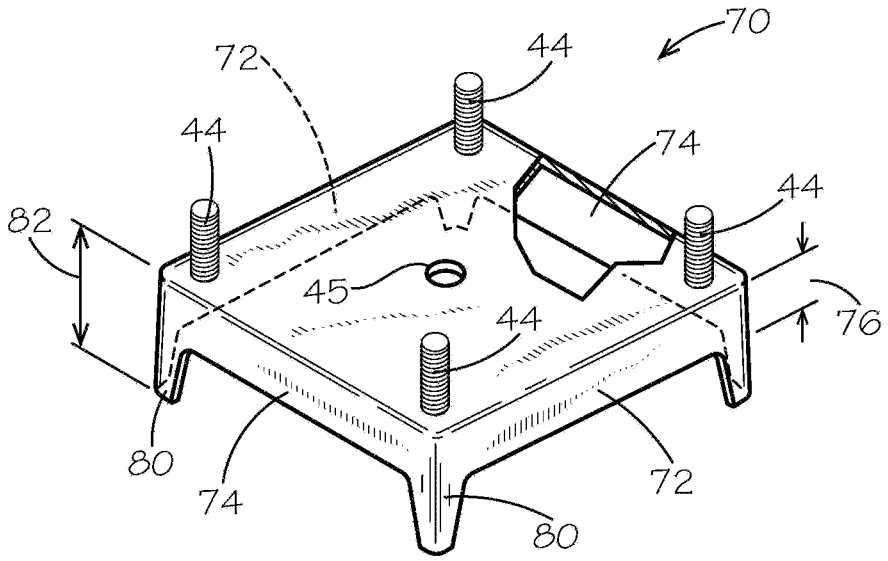
FIG. 3 illustrates in perspective view an alternate embodiment of the ground box for use with the anchor and light post assembly.

FIG. 3 illustrates an alternate embodiment ground box 70 for use with the anchor and light post assembly 10. The ground box 70 comprises a sheet having a top surface 78 of a length and a width. Side edge portions extend from the top surface 78 to define at least a first pair of opposing ground blades 72, and as illustrated for a preferred embodiment, a second pair of opposing ground blades 74, which ground blades extend a first distance 76 from the top surface 78. In this embodiment, the top surface 78 defines a plurality of opening, and a respective one of a plurality of threaded fasteners 44 extends through a respective opening in a second direction from the top surface 78. The openings, and the fasteners 44 therethrough, are spaced for alignment with the openings 56 of the light post base 50. The fasteners 44 in the illustrated embodiment are bolts that extend through the openings in the top surface to position the bolt head against a bottom surface and the threaded stem extending upwardly from the top surface. The bolt heads weld to the bottom surface. Alternative, the fasteners 44 may be bolts welded to the top surface 78. The top surface 78 also defines the central opening 45 for connecting to the anchor 20.

In the illustrated embodiment, the ground box 70 is formed from a metal sheet. The sheet is stamped to define the depending ground blades 72, 74. In an alternate embodiment the ground box 70 is a molded plastic member. In an alternate embodiment illustrated in FIG. 3, the ground box 70 further includes a plurality of legs 80 extending from adjacent ground blades 72, 74 at intersections thereof. The legs 80 may extend to a distal extent that is a second distance 82 from the top surface, with the second distance greater than a first distance 76 of the distal extent of the ground blades.

The ground box 22, 70 thus in an alternate embodiments comprises a plate with the plurality of threaded fasteners 44 extending from a first surface for aligned receiving with the openings 56 in the light post base 50, the central opening 45, and an opposing surface configured with ground engaging members. The ground engaging members may be the head of the bolt that attaches to the bottom opposing surface of the plate and the threaded shaft 23 that extends through an opening 45. In an alternate embodiment, the ground engaging members comprise spikes (not illustrated) that extend through openings in the plate into the ground.

Soil conditions vary, and sandy or loose soil may require a longer anchor rod 23, additional flights 24, wider members 46 of the frame 42 or blades 42 to extend deeper into the ground 16, or combination, while the components for use in more dense or clay type soils may differ.

Figure 4:
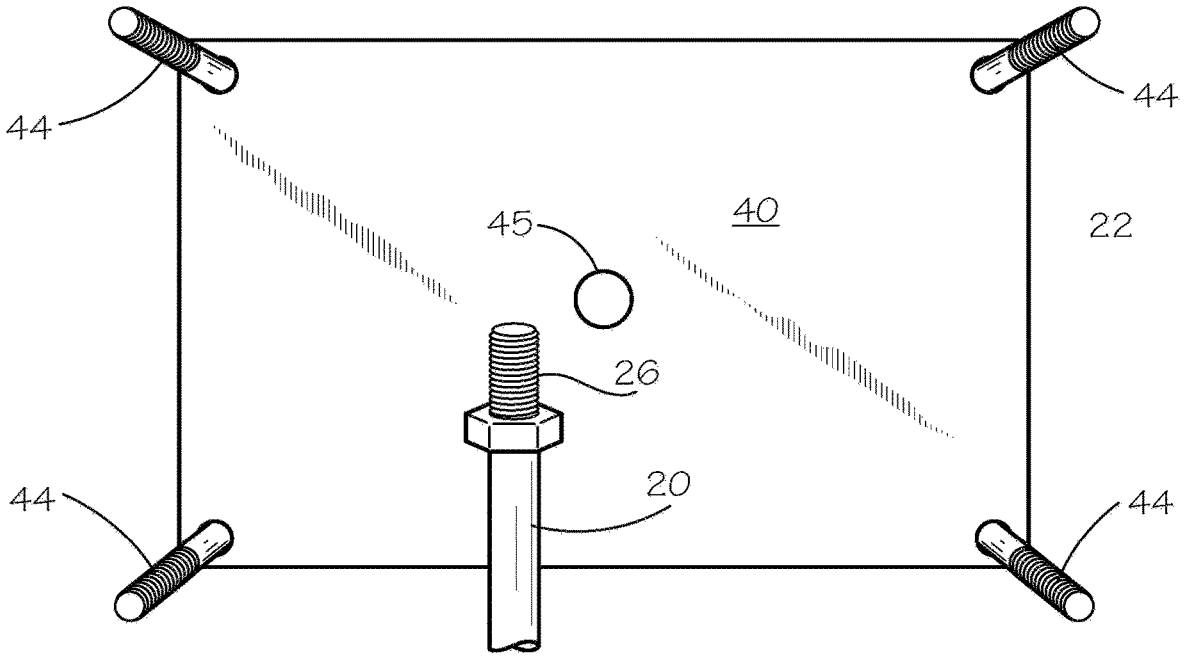
FIG. 4 illustrates a top plan view of the ground box illustrated in FIG. 2.
Figure 5:
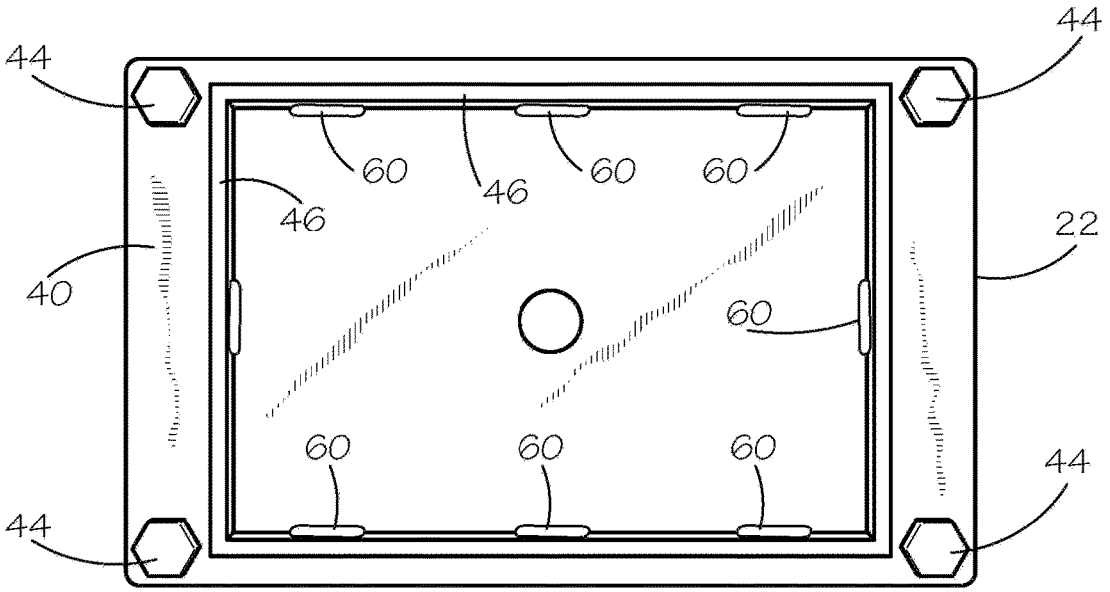
FIG. 5 illustrates a bottom plan view of the ground box illustrated in FIG. 2.

FIG. 4 illustrates a top plan view of the ground box 22 with the threaded fasteners 44. In this embodiment, and in reference to FIG. 5 illustrating a bottom view thereof, the threaded fasteners 44 are bolts that extend through openings in the plate 40 and weld on the bottom surface of the plate. With continued reference to FIG. 4, the elongated steel rod 23 is illustrated lying on the plate 40 with the threaded distal end 26 proximate the opening 45 for illustration purposes. The threaded end 26 extends through the opening 45 and engages the nut 28 (shown in FIG. 1) to secure the ground box 22 to the anchor 20.

FIG. 5 illustrates a bottom plan view of the ground box. The elongate members 46 weld 60 to the plate 40. The elongate members 46 knife into the ground during installation, and may in an alternate embodiment have an angled stepped edge or serrations for assisting in piercing the ground during installation. The threaded fasteners 44 are bolts that extend through openings in the plate 40 and weld on the bottom surface of the plate.

Figure 6:
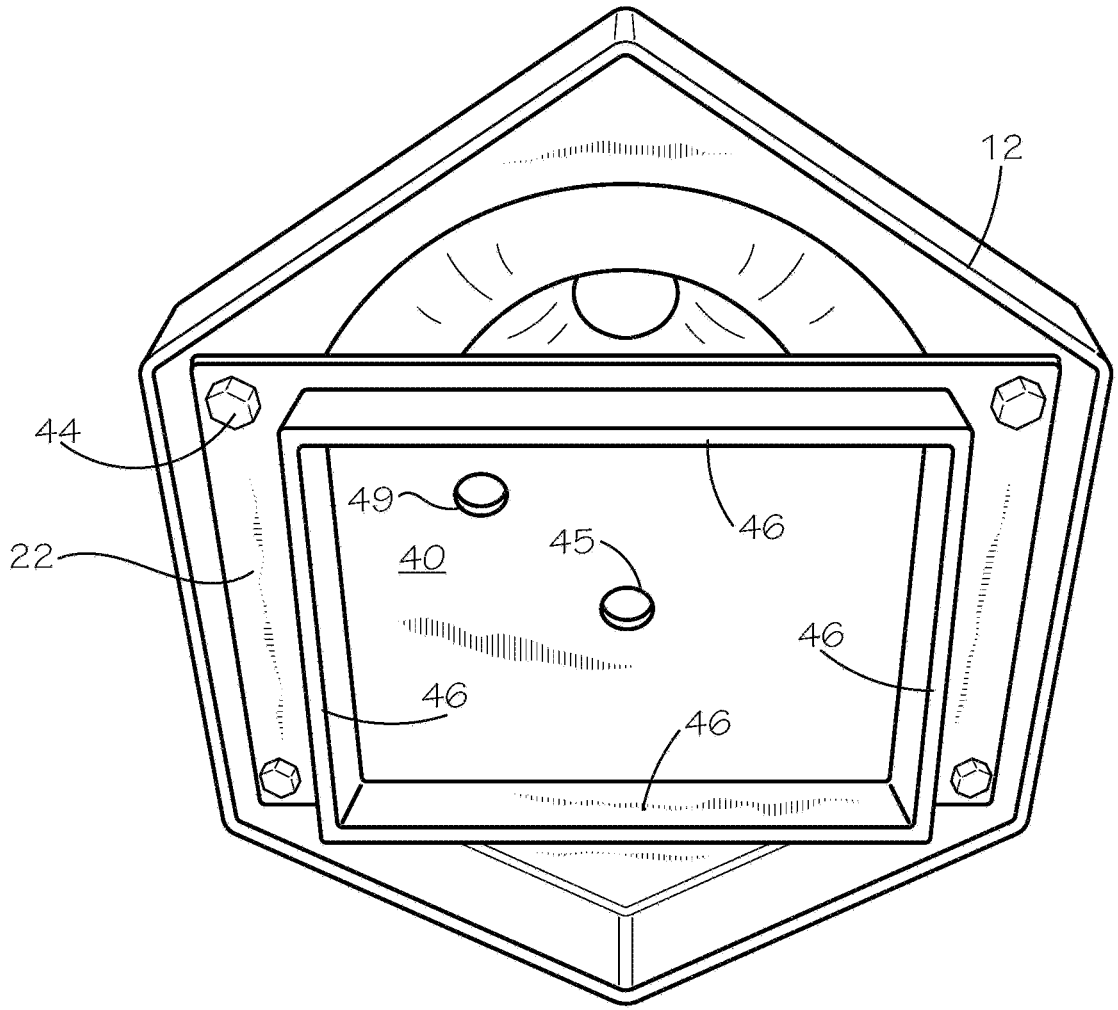
FIG. 6 illustrates a bottom view of a light post base seated on the ground box illustrated in FIG. 2.

FIG. 6 illustrates a bottom view of the light post base 12 seated on the ground box 22 with the threaded fasteners 44 aligned and extending through the openings 56.

Figure 7:
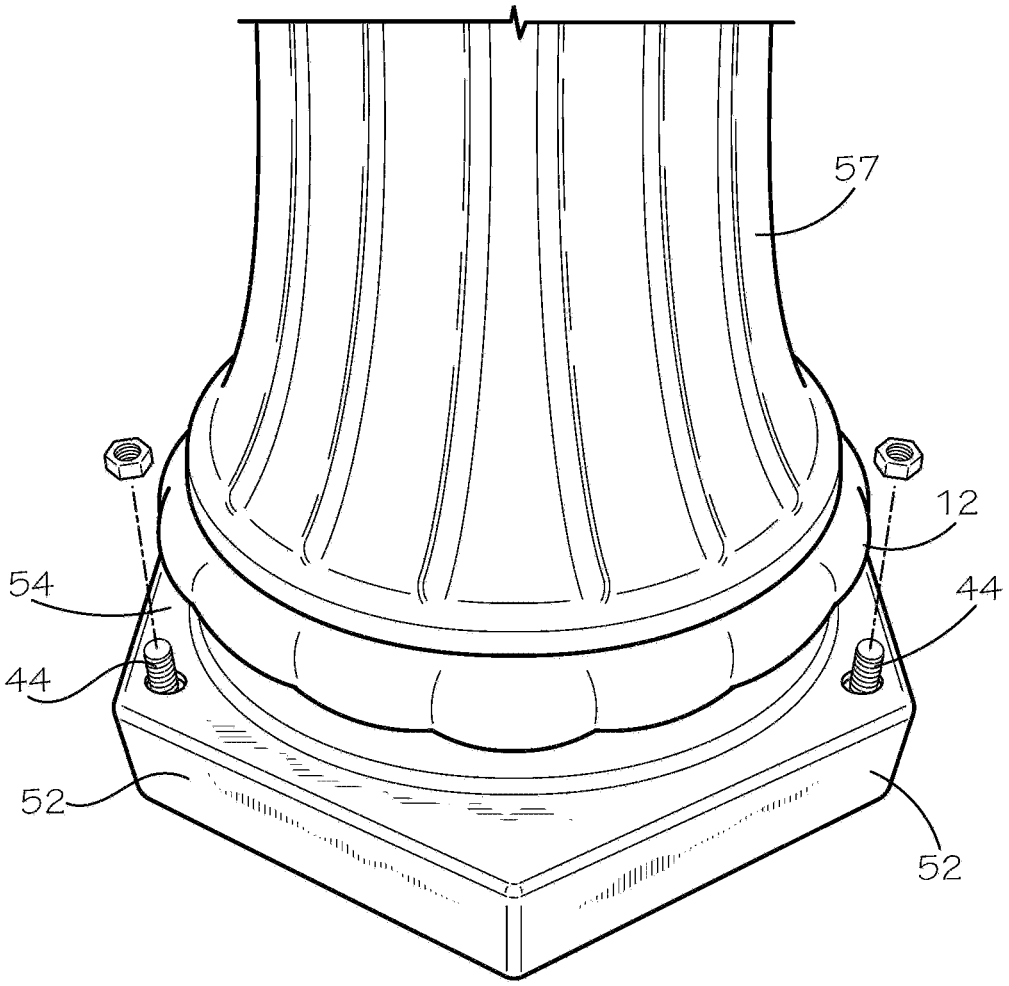
FIG. 7 illustrates an upper perspective view of the light post base seated on the ground box with a plurality of threaded fasteners extending through aligned openings in the light post base.

FIG. 7 illustrates an upper perspective view of the light post base 12 seated on the ground box 22 with the threaded fasteners 44 extending through the aligned openings 56 in the light post base, before receiving the nuts 58 for securing the light post base to the ground box. An ornamental housing 57 may surround or be defined in combination with the annular collar 55 that receives the elongated post 50.

Figure 8:
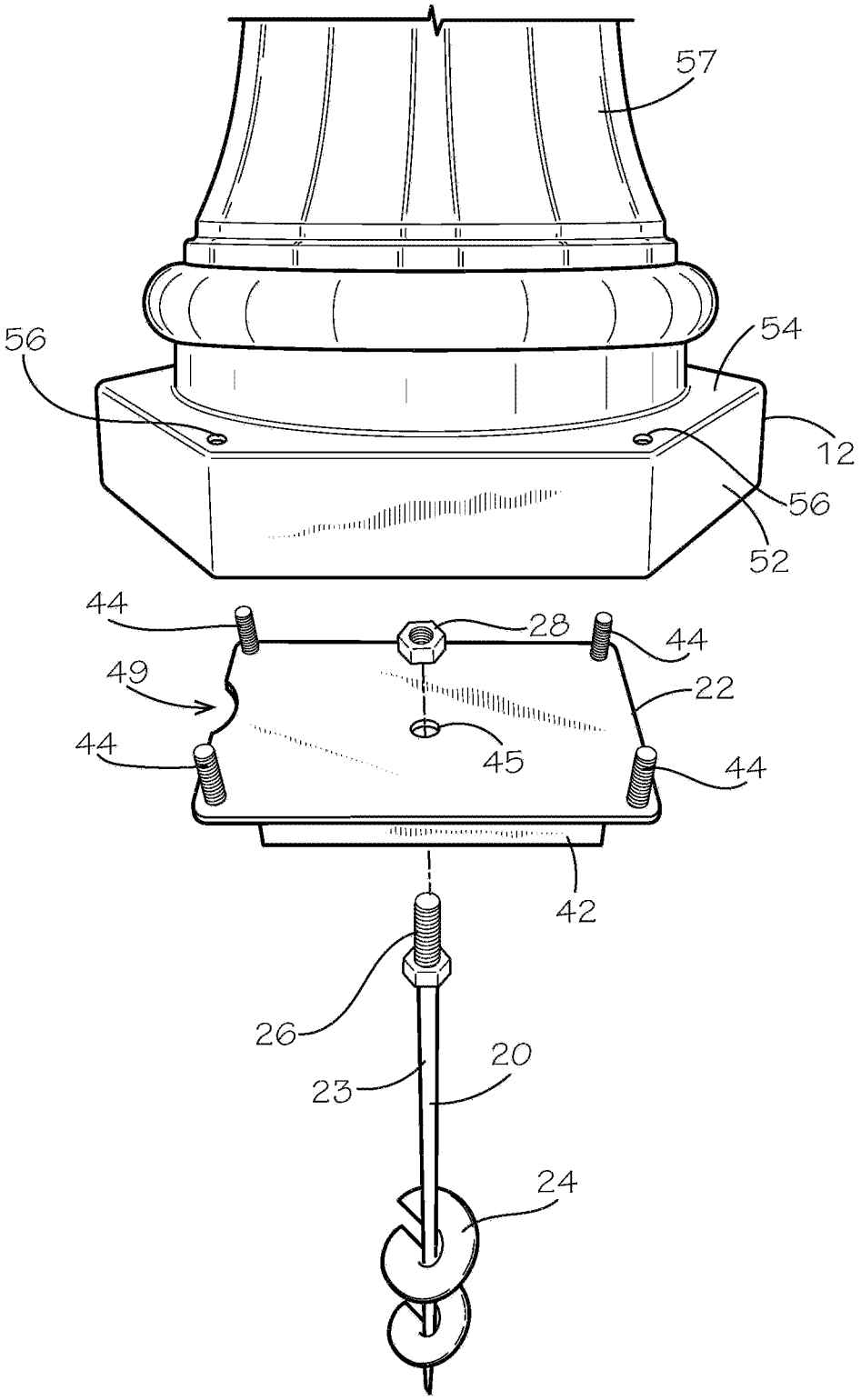
FIG. 8 illustrates a perspective exploded view of the ground anchor foundation and ornamental light pole base for the anchor and light post assembly.

FIG. 8 illustrates in perspective exploded view the ground anchor foundation 22 and ornamental light pole base 12 for the anchor and light post assembly 10, with the anchor 20 and a plurality of flights 24 proximate a lower end of the rod 23.

With reference to FIG. 1, the anchor and light post assembly 10 readily installs in the ground 16 and attaches to the ground box 22 and the light post base 12, for supporting a light fixture on the elongated post 50. A power driver tool having a socket engages the end of the anchor 20, and upon rotation, the flights 24 dig the anchor 20 into the ground 16. In the embodiment having the ground cap 30, the skirt wall 32 seats in the ground to provide resistance to lateral forces on the assembly 10. The threaded end 26 extends upwardly from the ground 16.

The ground box 22 installs over the anchor 20 with the threaded end 26 extending through the opening 45. The ground box 22 is forced into the ground with distal edges of the elongate members 46 cutting into the ground. For example, the ground box 22 may be driven by hamming on the plate 40. The nut 28 threads on the distal end of the anchor stem 23 to rigidly secure the ground box 22 to the anchor 20. The nut 28 tightened on the anchor stem 23 assists with forcing the plate 40 into the ground surface 16. The downward movement of the plate 40 and the upward pulling on the anchor 20 compresses the soil in the ground 16 between the plate and the helical flights 24.

As shown in FIGS. 7 and 8, the light post base 12 seats on the ground box 22, with the threaded fasteners 44 extending through the aligned openings 56. The nuts 58 threadingly engage the fasteners 44 and upon tightening, drive the wall 52 into the ground around the ground pan 22. The post 50 seats in the annular collar 55 of the light post base 12. Fasteners (not illustrated) such as screws or bolts that engaged threaded connectors on the post 50 secure the post to the collar 55. The light fixture conventionally attaches to the post 50, and suitable power connections are made for operating the light fixture. It is to be appreciated that the plate 40 may include a notch or opening 49 for passage of electrical wires such as from a conduit (not shown) installed in a trench or electrical junction box in the ground proximate the light post assembly for passage of wires into and through the light post base 12 into the collar 55 and elongated post 50, for connecting a light fixture with a source of electrical current for operating the light fixture.

The foregoing discloses a readily installed foundation and support structure for electrical lighting fixtures that mount to elongated posts for illuminative and ornamental purposes for grounds, parks, buildings, walkways and the like. While this invention has been described in detail with particular references to illustrated embodiments thereof, it should be understood that many modifications, additions and deletions, in additions to those expressly recited, may be made thereto without departure from the spirit and scope of the invention recited in the appended claims.

What is claimed is:

1. An anchor and light post assembly, comprising:

an anchor having an elongated rod and at least one helical flight proximate a first end of the rod and an opposing threaded end;

a ground box comprising a plate with a plurality of walls extending in a first direction from a first surface of the plate and a plurality of fasteners extending in a second direction from the plate, the plate defining an opening for receiving therethrough the threaded end of the anchor for receiving a nut thereon to securing the anchor to the ground box; and a light post base having a plurality of openings for aligned receiving of the fasteners extending from the ground box and receiving nuts thereon to secure the light post base to the ground box.

2. The anchor and light post assembly as recited in claim 1, wherein the threaded end comprises a bolt welded coaxially to the rod.

3. The anchor and light post assembly as recited in claim 1, wherein the plate defines a plurality of spaced-apart second openings and the fasteners comprise threaded members each extending through a respective one of the second openings.

4. The anchor and light post assembly as recited in claim 3, wherein the threaded members comprise bolts, each with a bolt head secured to a bottom surface of the plate and a threaded stem extending through the second opening.

5. The anchor and light post assembly as recited in claim 1, wherein the ground box comprises a sheet stamped to define the plate and at least two opposing ground blades depending therefrom.

6. The anchor and light post assembly as recited in claim 5, wherein the ground box comprises a second pair of opposing ground blades depending from the plate.

7. The anchor and light post assembly as recited in claim 6, wherein the ground box further comprises a leg extending from end portions of adjacent ground blades.

8. The anchor and light post assembly as recited in claim 1, further comprising a ground cap received on the rod, the ground cap having a cap plate for seating on a ground surface and a skirt depending from the perimeter of the cap plate for inserting into the ground.

9. The anchor and light post assembly as recited in claim 1, wherein the light post base further comprises an annular collar for receiving an elongated light fixture post.

10. The anchor and light post assembly as recited in claim 1, wherein the light post base further comprises an ornamental housing enclosing an annular collar for receiving an elongated light post.

11. The anchor and light post assembly as recited in claim 1, wherein the plate further comprising a passage therein for receiving electrical wires therethrough to communicate electrical current form a source to a light fixture.

12. A method of securing an anchor and light post assembly for supporting an ornamental light fixture, comprising the steps of:

(a) driving an anchor into a ground surface, which anchor comprises an elongated rod and at least one helical flight proximate a first end of the rod and an opposing threaded end, leaving the threaded end extending upwardly from the ground surface;

(b) positioning a ground box over the threaded end that extends through an opening defined in a plate of the ground box and securing with a nut, the plate having a plurality of walls extending in a first direction for entry into the ground and a plurality of fasteners extending in a second direction from the plate; and (c) aligning a light post base onto the ground box, the light post base having a plurality of openings for receiving the fasteners extending from the ground box and threading with one of a plurality nuts to secure the light post base to the ground box.

* * * * *